US006637929B2

(12) United States Patent
Baron

(10) Patent No.: US 6,637,929 B2
(45) Date of Patent: Oct. 28, 2003

(54) METHOD FOR AGITATING A FLUID SUSPENSION

(75) Inventor: Richard D. Baron, Zephyrhills, FL (US)

(73) Assignee: Vitality Beverages, Inc.

( * ) Notice: Subject to any disclaimer, the term of this patent is extended or adjusted under 35 U.S.C. 154(b) by 0 days.

(21) Appl. No.: 10/256,433

(22) Filed: Sep. 27, 2002

(65) Prior Publication Data

US 2003/0031085 A1 Feb. 13, 2003

Related U.S. Application Data

(62) Division of application No. 09/925,998, filed on Aug. 9, 2001.

(51) Int. Cl.[7] ..... B01F 11/00

(52) U.S. Cl. ..... 366/348

(58) Field of Search ..... 366/108, 110, 366/111, 114, 117, 144, 197, 348, 200–204, 208, 210, 211, 216; 99/348; 222/105

(56) References Cited

U.S. PATENT DOCUMENTS 1,437,880 A * 12/1922 Baker
2,235,942 A * 3/1941 Moore
2,336,438 A * 12/1943 Evans
2,356,004 A * 8/1944 Price
2,406,535 A * 8/1946 Foote
2,419,330 A * 4/1947 Anderson
2,462,286 A * 2/1949 Rhodes
3,096,081 A * 7/1963 Helm et al.
3,132,848 A * 5/1964 Garlinghouse
3,211,432 A * 10/1965 Van Rossem
3,499,578 A * 3/1970 O'Neal
3,595,530 A * 7/1971 Hubers
3,740,028 A * 6/1973 Bodine
3,819,158 A * 6/1974 Sharpe et al.
3,833,203 A * 9/1974 Garlinghouse
4,198,166 A * 4/1980 Tuns
4,550,653 A * 11/1985 Hedenberg
4,550,654 A * 11/1985 Hedenberg
4,590,850 A * 5/1986 Hedenberg
4,784,297 A * 11/1988 Katz
4,803,086 A * 2/1989 Hedenberg
4,907,723 A * 3/1990 Katz
5,121,857 A * 6/1992 Hutchinson
5,141,135 A * 8/1992 Volk, Jr.
5,600,964 A * 2/1997 Da Dalto et al.
5,699,902 A * 12/1997 Sperry et al.
5,913,603 A * 6/1999 Sperry et al.
6,045,253 A * 4/2000 Sullivan
6,142,661 A * 11/2000 Lafond
6,186,360 B1 * 2/2001 Becker et al.
6,272,813 B1 * 8/2001 Sperry et al.
6,273,600 B1 * 8/2001 Sharpe
6,416,212 B1 * 7/2002 Rogers et al.

FOREIGN PATENT DOCUMENTS

| | | | |
|---|---|---|---|
| EP | 255780 | * | 2/1988 |
| EP | 360456 | * | 3/1990 |
| GB | 2230251 | * | 10/1990 |
| WO | 00/53303 | * | 9/2000 |

* cited by examiner

*Primary Examiner*—Charles E Cooley
(74) *Attorney, Agent, or Firm*—Carlton Fields, P.A.

(57) ABSTRACT

This invention provides an apparatus and a method for agitating a fluid suspension contained within an at least partially flexible vessel. This invention provides an apparatus comprising a structure for receiving the vessel, an agitating member capable of receiving the vessel, and a motor operatively communicating with the agitating member to substantially uniformly agitate the fluid suspension. This invention also provides a method comprising folding an at least partially flexible vessel so that there are two inner portions and reciprocally moving one or both of the inner portions between a first position and a second position, whereby the fluid suspension is substantially uniformly agitated.

10 Claims, 9 Drawing Sheets

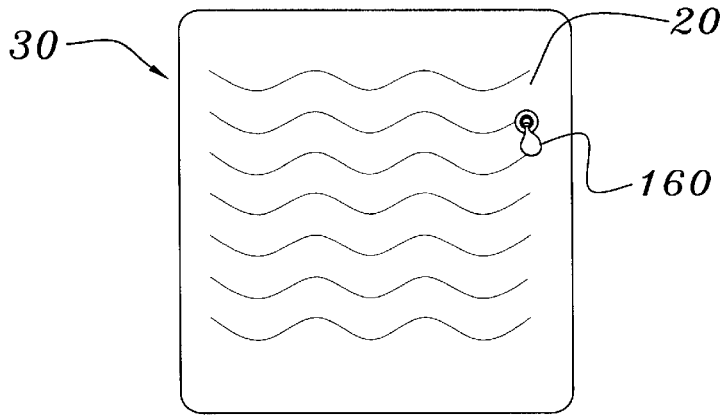
FIG. 5
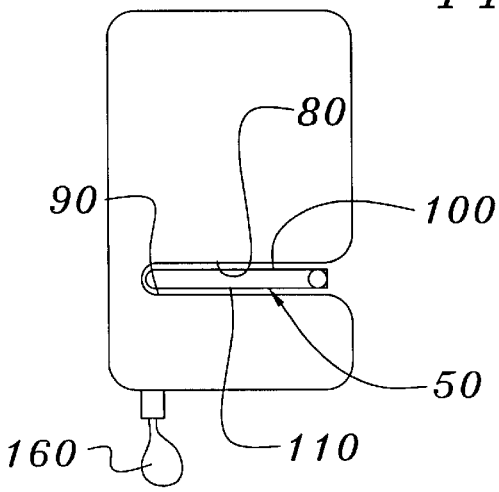
FIG. 7
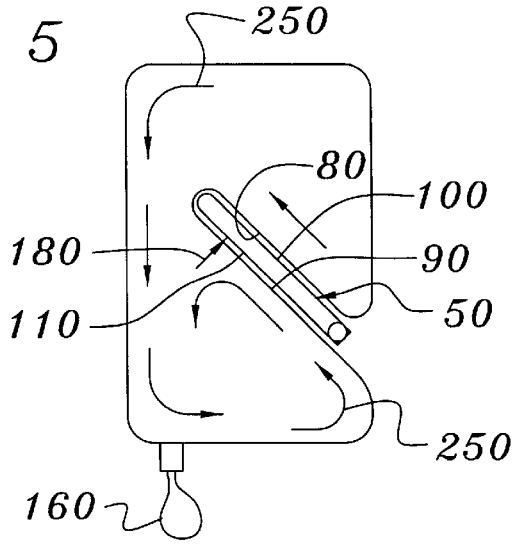
FIG. 11
FIG. 12
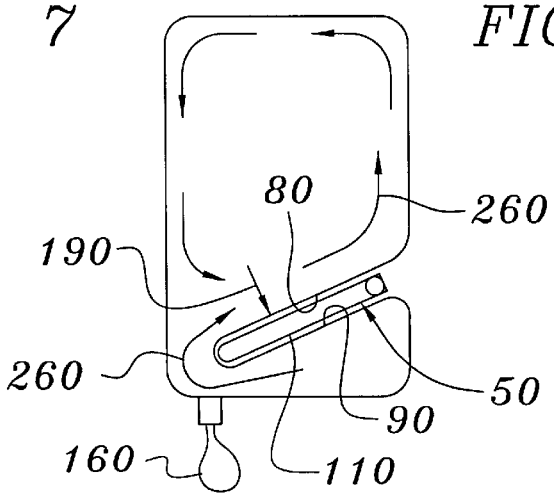

METHOD FOR AGITATING A FLUID SUSPENSION

RELATED APPLICATIONS

This application is a division of pending application Ser. No. 09/925,998, filed Aug. 9, 2001.

BACKGROUND OF THE INVENTION

This invention relates generally to the beverage industry, and more particularly to an apparatus and method for agitating a fluid suspension so that the fluid suspension is uniformly agitated and mixed, contained in a vessel for dispensing portions of the suspension.

The need to substantially uniformly agitate fluid suspensions for dispensing has long been felt. In the beverage industry, it is desirable to dispense beverages with consistent quality among all beverages dispensed. In order to ensure consistent quality, the sediment within the fluid suspension being dispensed must be thoroughly and uniformly agitated and mixed. If the fluid suspension is not properly agitated, then the beverage dispensed will contain an improper amount of suspended material. For example, if an orange juice dispenser does not adequately agitate the vessel containing the orange juice, some glasses of juice dispensed will contain more pulp than other glasses of juice dispensed from the same dispenser.

Methods for agitating fluid suspensions are well known in the art. Some have attempted to blend the contents of a bag using an actuator to reciprocally exert and release pressure upon a single portion of a flexible container. However, such methods do not adequately or uniformly agitate the fluid suspensions. Applying pressure to only a portion of the vessel simply displaces the suspended materials away from the point of pressure. Typically, this forces the suspended materials to the corners of the vessel, so that the fluid suspension is not substantially uniformly agitated. Therefore, an apparatus and method are needed that substantially uniformly agitates a fluid suspension.

SUMMARY OF THE INVENTION

This invention provides an apparatus and a method for agitating a fluid suspension contained within an at least partially flexible vessel. This invention provides an apparatus comprising a structure for receiving the vessel such that a portion of the vessel rests proximate to one side of an agitating member and another portion of the vessel rests proximate to another side of the agitating member, and a motor operatively communicating with the agitating member to substantially uniformly agitate the fluid suspension. This invention also provides a method comprising folding an at least partially flexible vessel so that there are two inner portions and reciprocally moving one or both of the inner portions between a first position and a second position, whereby the fluid suspension is substantially uniformly agitated.

BRIEF DESCRIPTION OF THE DRAWINGS

A particularly preferred embodiment of the invention will be described in detail below in connection with the drawings in which:

FIG. 5 is a plan view of an at least partially flexible vessel used in this receiving structure of FIG. 4;

FIG. 7 is a side view of the vessel of FIG. 5 folded over the agitator of the apparatus of FIG. 4;

FIG. 11 is a side view of the vessel of FIG. 7 illustrating the manner in which a fluid suspension may be substantially uniformly agitated;

FIG. 12 is a side view of the vessel of FIG. 7 further illustrating the manner in which a fluid suspension may be substantially uniformly agitated;

DESCRIPTION OF PREFERRED EMBODIMENTS

Figure 1:
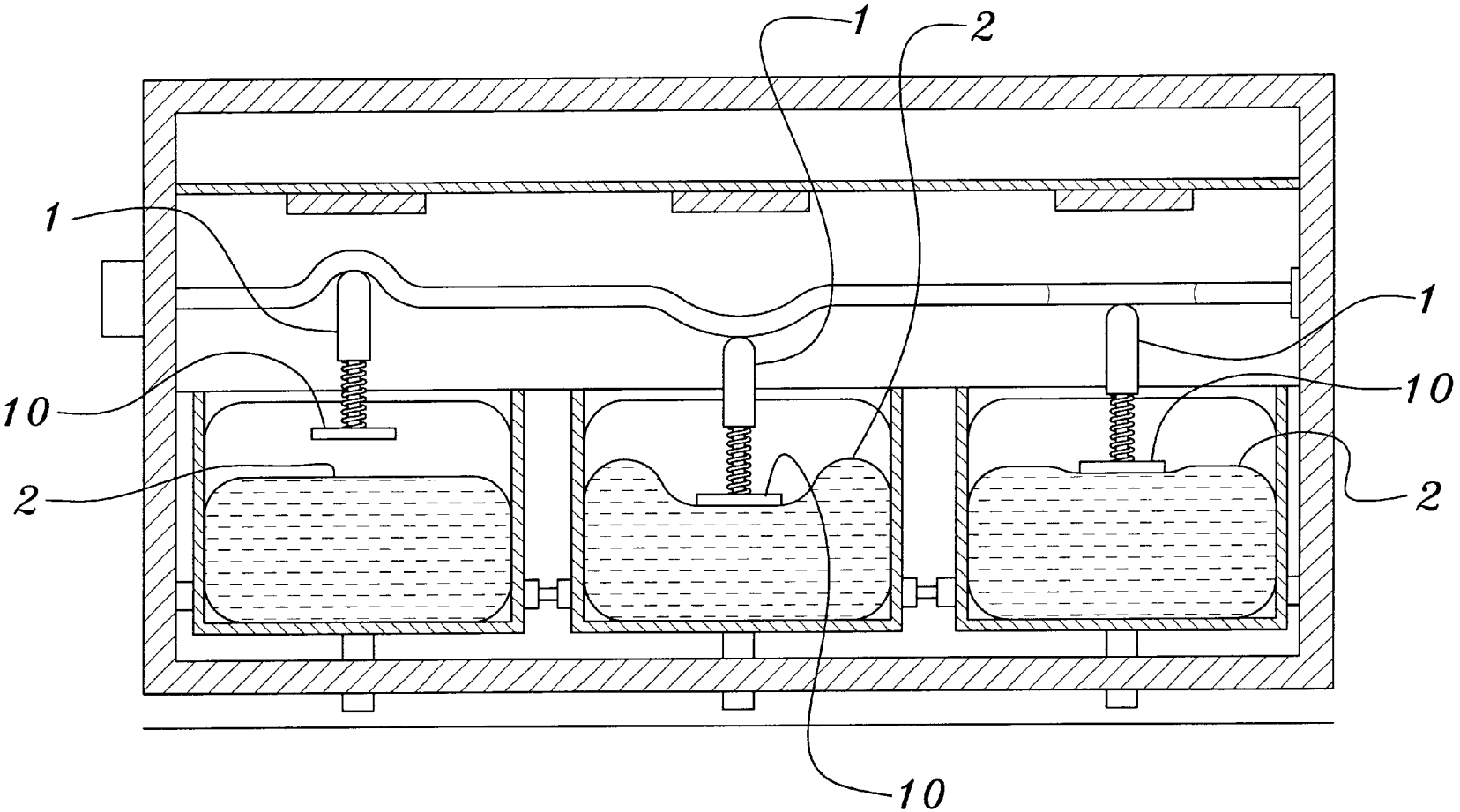
FIG. 1 (Prior Art)
FIG. 1 is a schematic representation of an example of an apparatus of the prior art.
Figure 2:
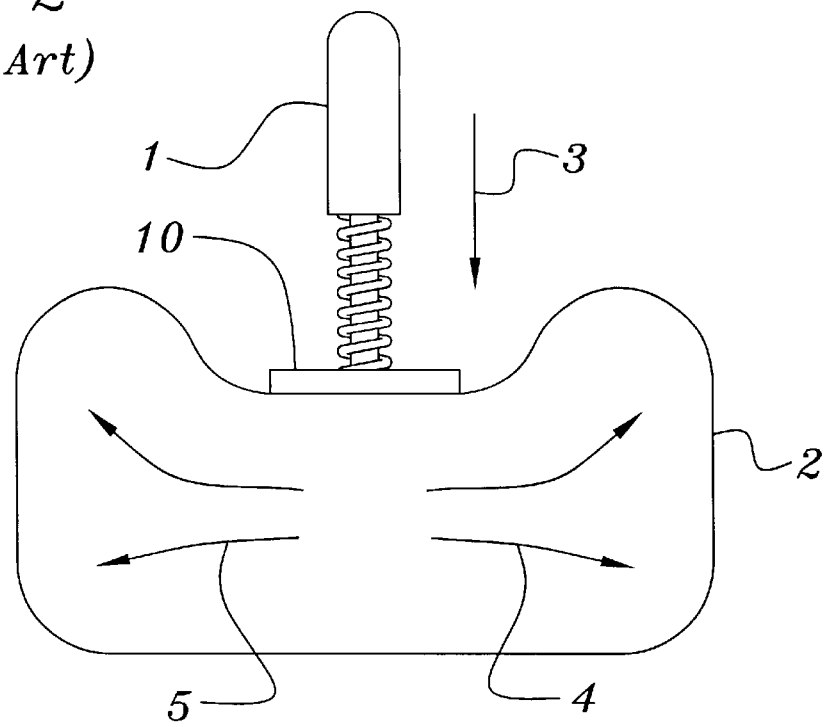
FIG. 2 (Prior Art)
FIG. 2 is a schematic representation of an example of the flow of suspended material as a result of a prior art apparatus.
Figure 3:
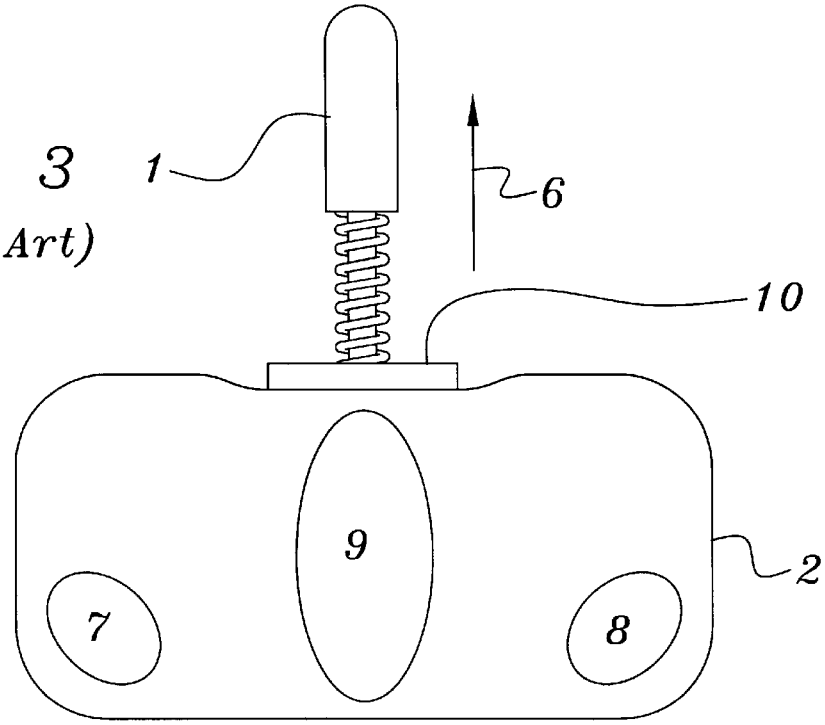
FIG. 3 (Prior Art)
FIG. 3 is a schematic representation of an example of the flow of suspended material as a result of a prior art apparatus.

In the prior art, as illustrated in FIGS. 1–3, an actuator 1 reciprocally depresses and releases a bag 2. The pressure exerted in the direction 3 by the actuator 1 on plunger 10 forces the suspended material in the bag 2 to travel in directions 4 and 5, away from the center of the bag 2 and towards the sides of the bag 2. When the actuator releases in a direction 6, the suspended material settles in areas 7 and 8, with little suspended material in area 9. As a result, beverages dispensed from the bag 2 are not uniform in composition.

Figure 4:
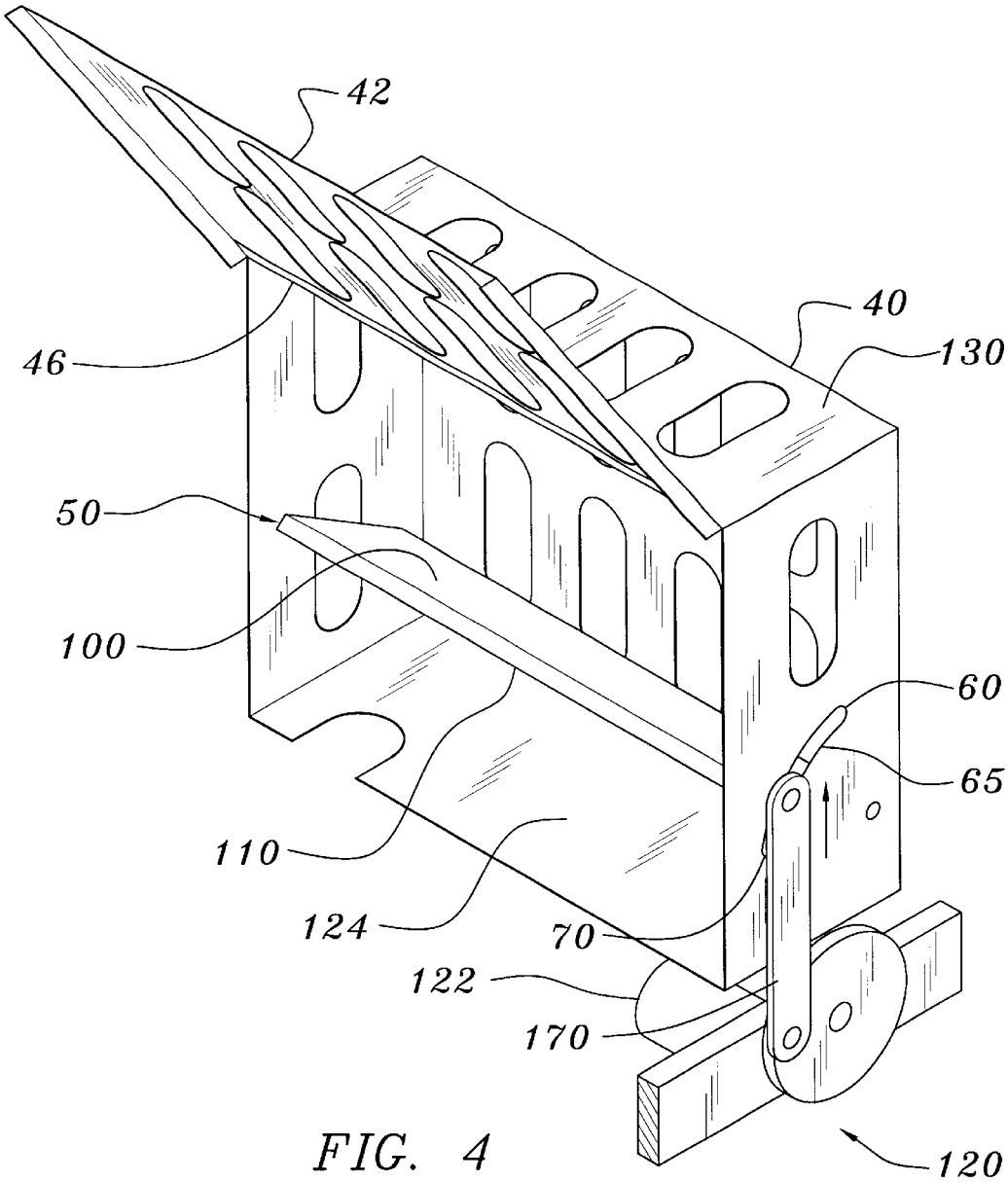
FIG. 4 is a perspective view of a preferred embodiment of the receiving structure of this invention in a loading position.
Figure 6:
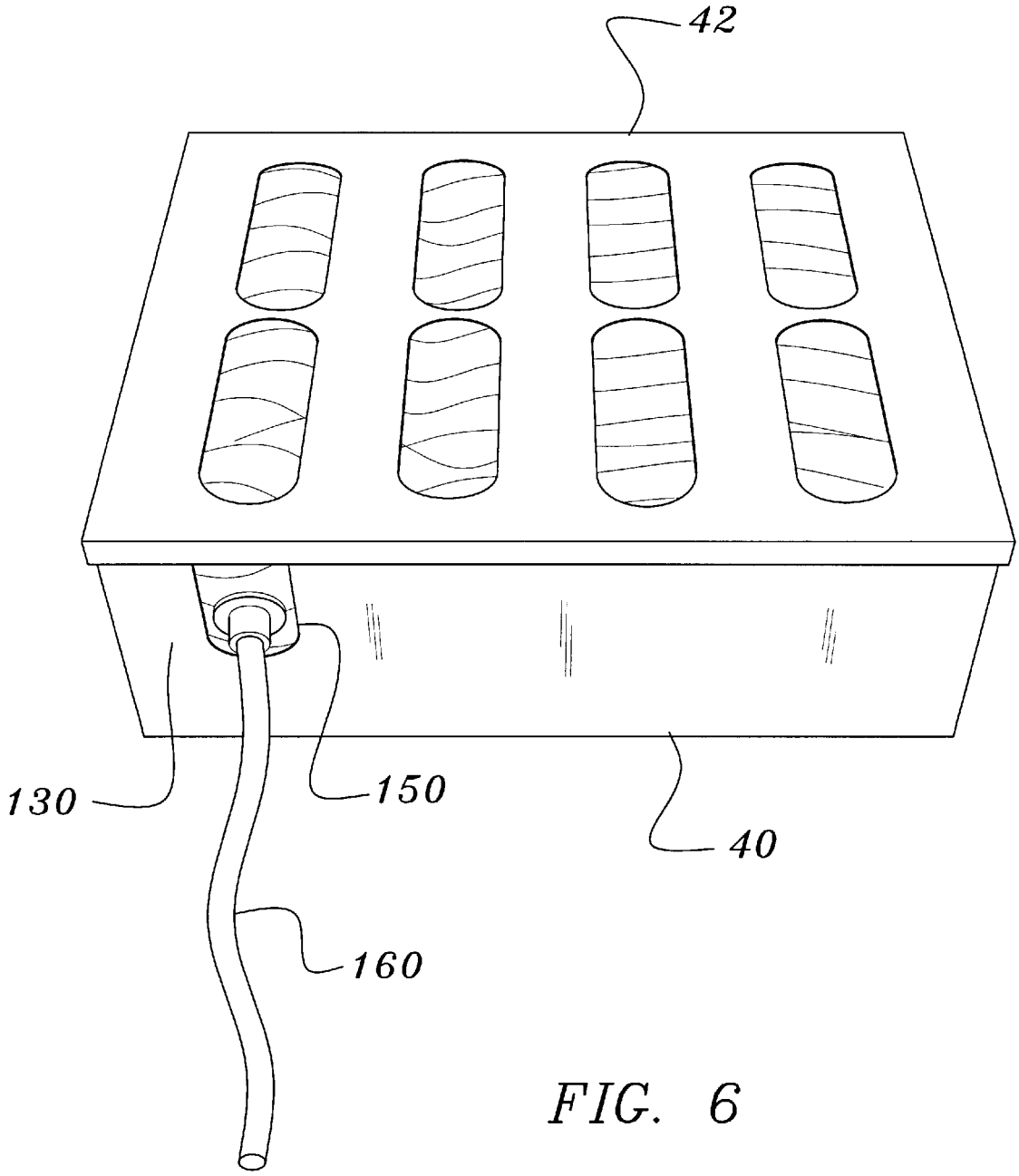
FIG. 6 is a perspective view of the receiving structure of this invention in an operating position.

The present invention overcomes this problem in the prior art. Particularly preferred embodiments of the present invention are illustrated in the drawings, which illustrate a preferable apparatus and method for agitating fluid suspensions contained within an at least partially flexible vessel. FIGS. 4 through 8 illustrate an apparatus generally indicated by reference numeral 10, for agitating a fluid suspension 20 contained within an at least partially flexible vessel 30. In one preferred embodiment, the at least partially flexible vessel 30 is completely flexible. Suitably, the apparatus has a structure 40 for receiving the at least partially flexible vessel 30. In one preferred embodiment, the structure 40 is temperature controlled using any device or method that is well known in the art. Suitably, the structure 40 may be refrigerated or heated. As shown in FIGS. 4 and 6, the structure has a panel 42 that is suitably adjustable between a first, open, loading position shown in FIG. 4, where the vessel may be conveniently removed from or inserted into the structure 40, and a second, closed, operating position, shown in FIG. 6, where the vessel 30 is retained within the structure 40 in a position suitable for an agitating member 50 to substantially uniformly agitate the fluid suspension. Conveniently, hinges 46 permit the panel, or door, 42 to be moved between the first loading position and the second operating position.

Preferably, the structure 40 has an agitating member 50 operatively located within the structure 40, and the agitating member 50 is suitably movable in an arcuate path between a first position, proximate first end 60 of arcuate slot 65 in structure 40, and a second position proximate second end 70 of said slot 65. As illustrated in FIGS. 4 and 7, the at least partially flexible vessel 30 is conveniently positioned such that a first inner portion 80 rests substantially proximate to a first side 100 of the agitating member 50. Likewise, a second inner portion 90 of the at least partially flexible vessel 30 rests substantially proximate to a second side 110 of the agitating member 50.

Figure 8:
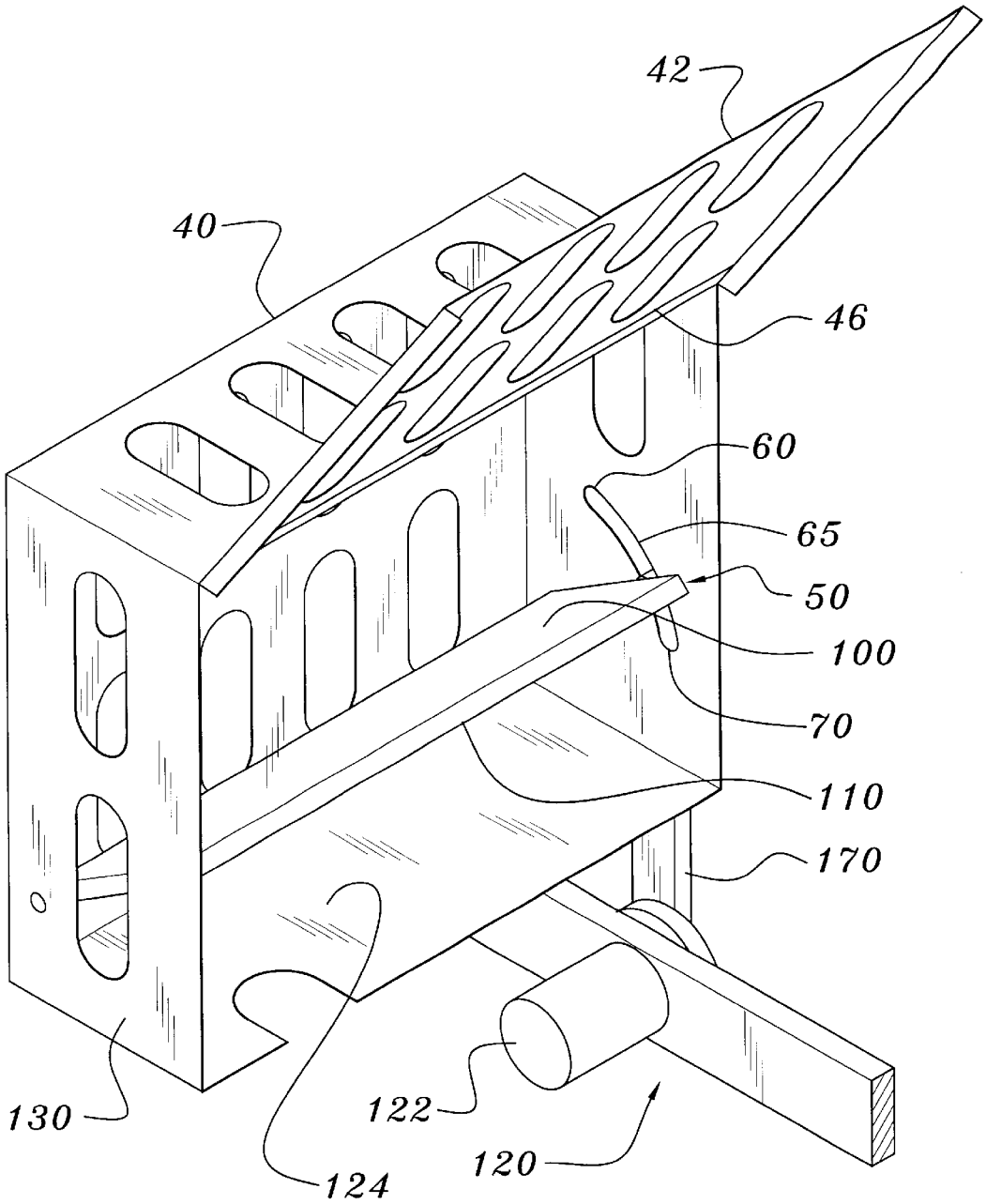
FIG. 8 is another perspective view of the apparatus of FIG. 4.
Figure 9:
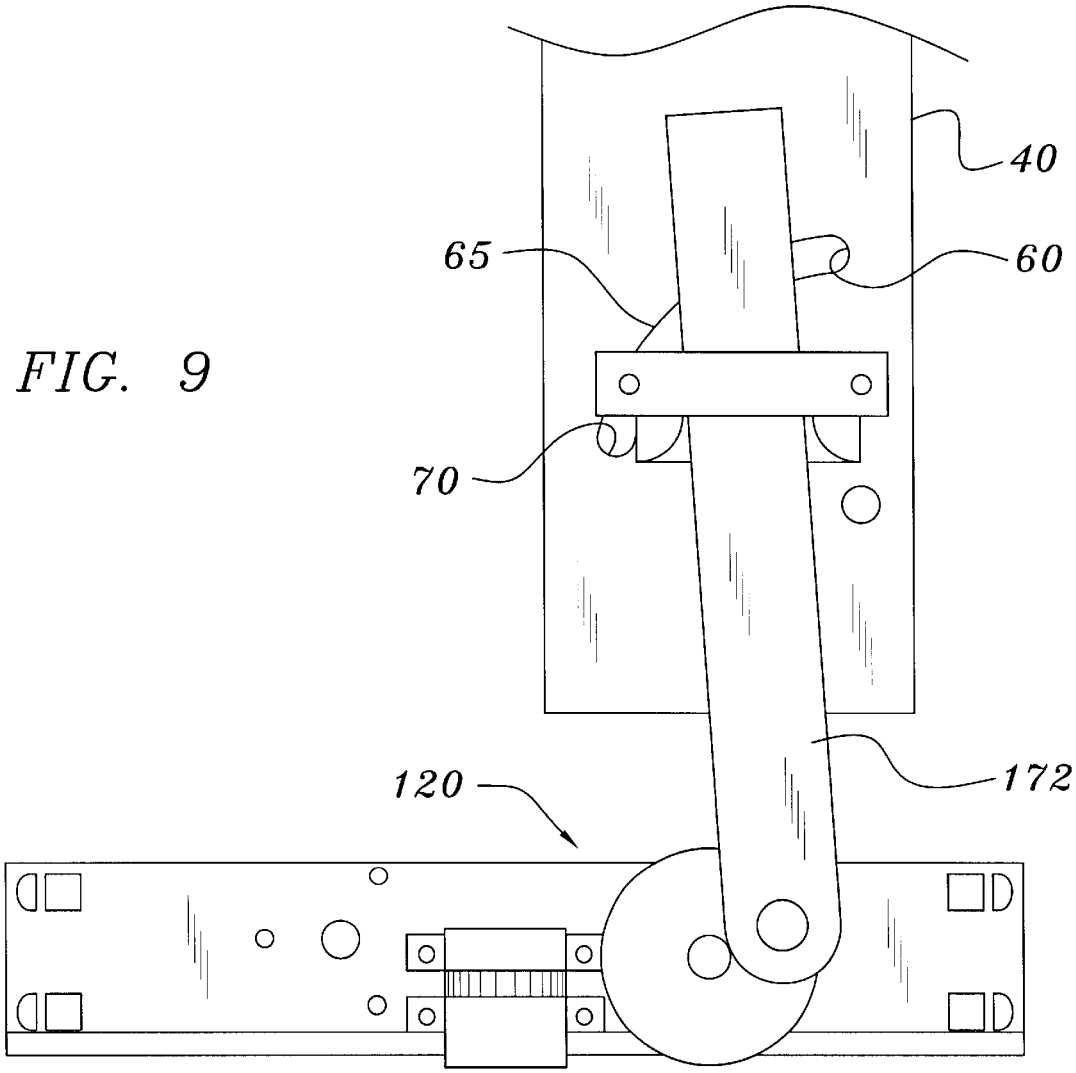
FIG. 9 is a side view of the apparatus of FIG. 4.

Conveniently, a motor 120, herein illustrated by a schematic representation representing any device to impart motion known in the art, including motion imparted through manual operation, is operatively communicated to the agitating member 50. Most preferably, the motor 120 operatively communicates with the agitating member 50 through a linkage 170. FIG. 8 illustrates a preferred motor 122 and a preferred linkage 172. FIG. 9 illustrates the linkage 172 from a side view. When in operation, the motor 120 suitably causes the agitating member 50 to move between the first position and the second position to substantially uniformly agitate the fluid suspension 20. In one preferred embodiment, the motor 122 imparts reciprocal motion to the agitating member 50 by moving the linkage 172 and agitating motion to a first position 60 and a second position 70.

Figure 10:
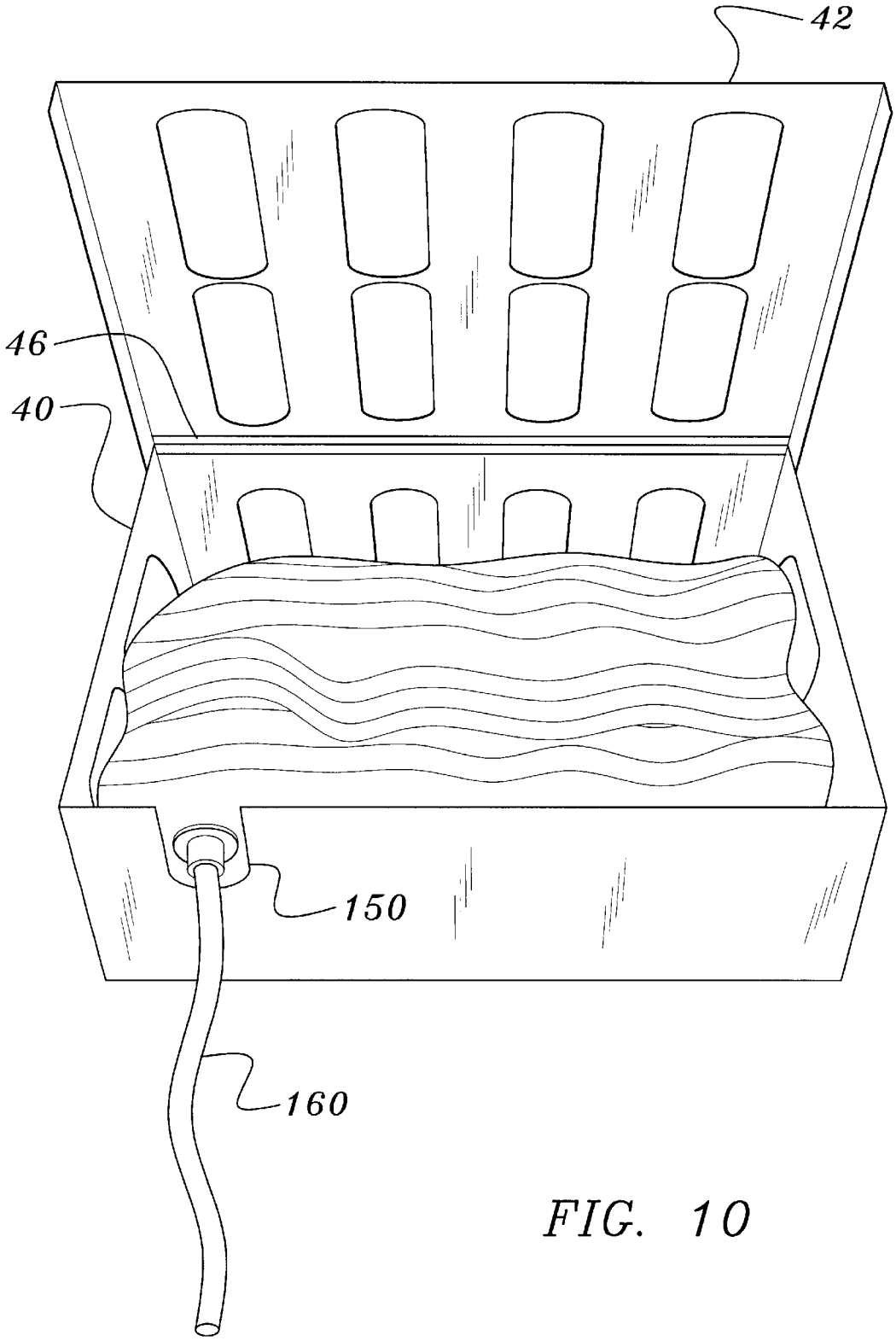
FIG. 10 is a perspective view of the receiving structure of FIG. 4 with the vessel of FIG. 5 positioned within and a dispensing tube and a passage operatively associated.

In a preferred embodiment, the structure 40 defines an inner portion 124 of the structure and an outer portion generally represented by the reference numeral 130. Conveniently, a passage 150 is disposed between the inner portion 124 and the outer portion 130 of the structure 40. The passage 150 is utilized in dispensing the fluid suspension 20 from the inner portion 124 to the outer portion 130 of the structure 40. As shown in FIG. 10, the at least partially flexible vessel 30 suitably has a dispensing tube 160 that is operatively associated with the passage 150 for dispensing the fluid suspension 20 from the inner portion 124 to the outer portion 130 of the structure 40.

As illustrated in FIG. 7, to perform a particularly preferred method of this invention for agitating fluid suspensions contained within an at least partially flexible vessel, the at least partially flexible vessel 30 is folded such that there is an inner first portion 80 and an inner second portion 90. Looking at FIGS. 11 and 12, the agitating member 50 reciprocally moves the inner first portion 80 between a first position, shown in FIG. 11, and a second position, shown in FIG. 12. Suitably, the agitating member 50 also reciprocally moves the inner second portion 90 between a first position, shown in FIG. 11, and a second position shown in FIG. 12. This reciprocal motion conveniently substantially uniformly agitates the fluid suspension 20.

FIGS. 5, 11, 12, and 13 also illustrate the manner in which a preferred apparatus 10 and method 269 of this invention substantially uniformly agitates the fluid suspension 20. Looking at FIG. 11, the agitating member 50 exerts a force in the direction of reference number 180 on the inner first portion 80 of the at least partially flexible vessel 30, causing the inner first portion to travel to the first position, shown in FIG. 11. This movement causes the fluid suspension 20 to travel in a direction generally shown by the arrow of reference numeral 250. Preferably, as a result of the agitation of the fluid suspension 20, the inner second portion 90 of the at least partially flexible vessel 30 travels to the illustrated first position.

Conveniently, the agitating member then exerts a force in the direction of reference number 190 on the inner second portion 90 of the at least partially flexible vessel 30, causing the inner second portion 90 to reciprocally move from the first position illustrated in FIG. 11 to the second position illustrated in FIG. 12. Suitably, the inner first portion 80 reciprocally moves from the illustrated first position to the second position. The fluid suspension 20 preferably travels in a direction generally shown by the arrow of reference numeral 260. As a result of this reciprocal motion, the fluid suspension is substantially uniformly agitated.

In one preferred embodiment of the method of this invention, the at least partially flexible vessel 30 is loaded into a structure 40 for dispensing the fluid suspension 40. Structure 40 suitably defines an inner portion 124 and an outer portion 130 and has a passage disposed between the inner portion 124 and the outer portion 130 of the structure 40. A preferred method of this invention temperature controls the structure 40. In a preferred embodiment of the method of this invention, the at least partially flexible vessel 30 loaded into the structure 40 has a dispensing tube 160. Conveniently, a user of a method of this invention operatively associates the dispensing tube 160 with the passage 150 of the structure 40. As a final preferred act of the present invention, the fluid suspension is dispensed from the structure 40.

Figure 13:
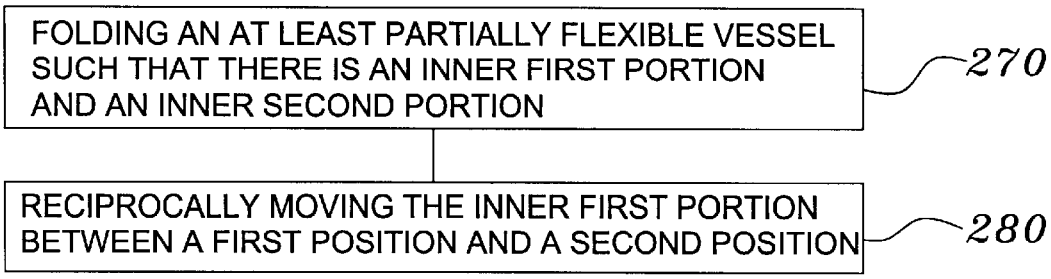
FIG. 13 is a flow chart illustrating a preferred method of this invention.

A preferred method 269 is illustrated in FIG. 13. Suitably, an act 270 is folding an at least partially flexible vessel such that there is an inner first portion and an inner second portion. Conveniently, another act 280 is reciprocally moving said inner first portion between a first position and a second position, whereby said fluid suspension is substantially uniformly agitated within said at least partially flexible vessel.

Figure 14:
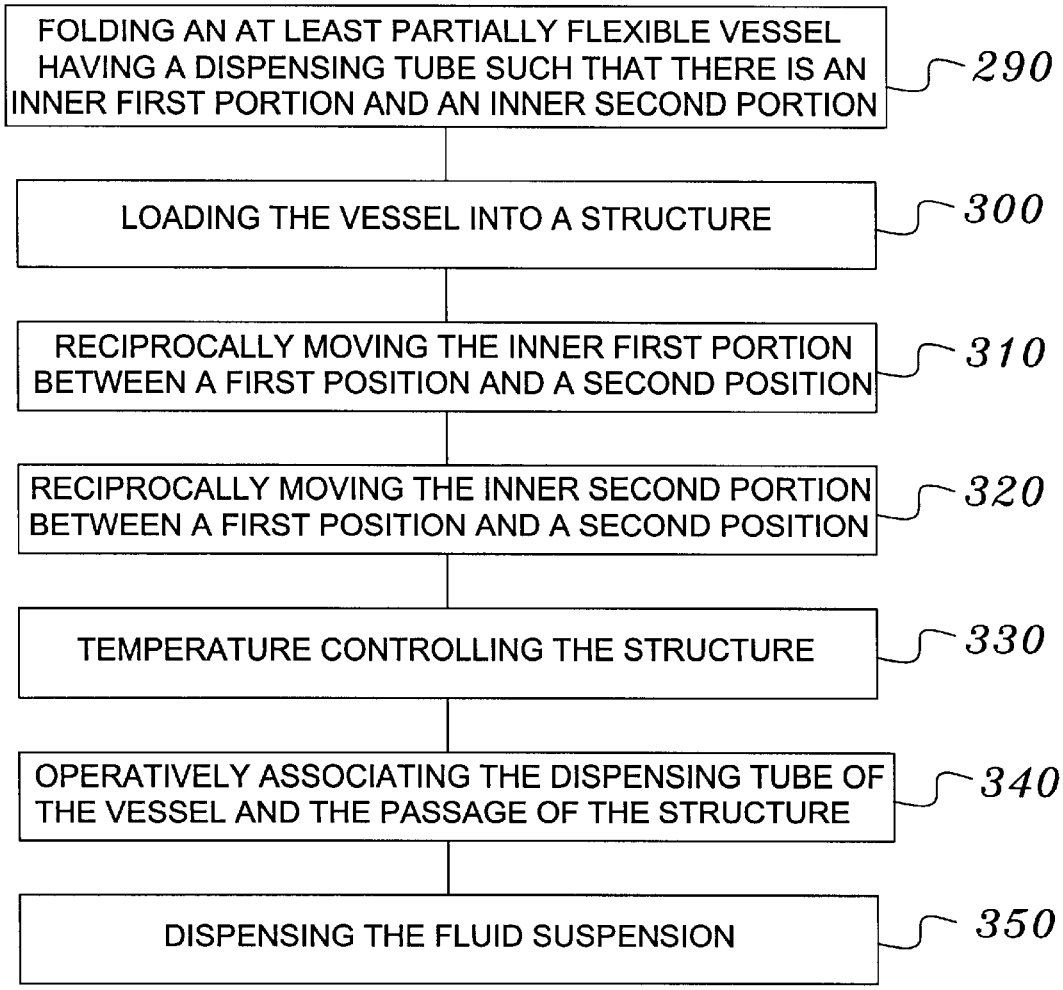
FIG. 14 is a flow chart illustrating a preferred method of this invention.

FIG. 14 illustrates another preferred method 289 of the present invention. An act 290 is, preferably, folding an at least partially flexible vessel having a dispensing tube such that there is an inner first portion and an inner second portion. Another convenient act 300 is loading the vessel into a structure. Preferably, this structure defines an inner portion of the structure, an outer portion of the structure, and a passage disposed between the inner portion and the outer portion for dispensing a fluid suspension. Suitably, an act 310 is reciprocally moving the inner first portion between a first position and a second position; whereby the fluid suspension is substantially uniformly agitated within the at least partially flexible vessel. An act 320 is reciprocally moving the inner second portion of the vessel between a first position and a second position. In a preferred method, another act 330 is temperature controlling the structure by any device or method well known in the art. An act 340 is operatively associating the dispensing tube of the vessel and the passage of the structure. Conveniently, an act 350 is dispensing the fluid suspension. It should be noted that these are acts for one preferred embodiment of the present invention, and the actual order of the steps is not critical to the invention.

What is claimed is:

1. A method for agitating a fluid suspension contained within an at least partially flexible dispensing vessel, comprising:

folding said vessel over an agitating member, which member has opposed first and second sides and is pivotally movable in an arcuate path about a pivot axis between a first position and a second position, such that said vessel is received with an inner first portion of said vessel overlying and resting substantially proximate to said first side of said agitating member and an inner second portion of said vessel overlying and resting substantially proximate to said second side of said agitating member; and reciprocally moving said agitating member about said pivot axis in said arcuate path between said first position and said second position, whereby said fluid suspension is substantially uniformly agitated within said vessel.

2. The method of claim 1, further comprising the act of loading said at least partially flexible vessel into a receiving structure.

3. The method of claim 2, further comprising the act of temperature controlling said structure.

4. The method of claim 3, further comprising the act of dispensing said fluid suspension.

5. The method of claim 2, further comprising the act of dispensing said fluid suspension.

6. The method of claim 1, further comprising the act of dispensing said fluid suspension.

7. The method of claim 1, further comprising the act of loading said at least partially flexible vessel into a receiving structure, said structure defining an inner portion of said structure and an outer portion of said structure and a passage disposed between said inner portion and said outer portion for dispensing said fluid suspension.

8. The method of claim 7, further comprising wherein said vessel loaded into said structure includes a dispensing tube, and wherein said act of loading further comprises the act of operatively associating said dispensing tube and said passage.

9. The method of claim 8, further comprising the act of dispensing said fluid suspension.

10. A method for agitating a fluid suspension contained within an at least partially flexible vessel having a dispensing tube, comprising:

folding said vessel over an agitating member, which member has opposed first and second sides and is pivotally movable in an arcuate path about a pivot axis between a first position and a second position, such that said vessel is received with an inner first portion of said vessel overlying and resting substantially proximate to said first side of said agitating member and an inner second portion of said vessel overlying and resting substantially proximate to said second side of said agitating member, and;

loading said vessel and said agitating member into a structure, said structure defining an inner portion of said structure and an outer portion of said structure and a passage disposed between said inner portion and said outer portion for dispensing said fluid suspension;

reciprocally moving said agitating member about said pivot axis in said arcuate path, whereby said fluid suspension is substantially uniformly agitated within said vessel;

temperature controlling said structure;

operatively associating said dispensing tube and said passage; and dispensing said fluid suspension.

* * * * *